US006700459B2

(12) United States Patent
Raihn et al.

(10) Patent No.: US 6,700,459 B2
(45) Date of Patent: Mar. 2, 2004

(54) DUAL-MODE BANDPASS FILTER WITH DIRECT CAPACITIVE COUPLINGS AND FAR-FIELD SUPPRESSION STRUCTURES

(75) Inventors: Kurt F. Raihn, Goleta, CA (US); Gregory L. Hey-Shipton, Santa Barbara, CA (US); Matthew Hernandez, Santa Barbara, CA (US)

(73) Assignee: Superconductor Technologies, Inc., Santa Barbara, CA (US)

( * ) Notice: Subject to any disclaimer, the term of this patent is extended or adjusted under 35 U.S.C. 154(b) by 0 days.

(21) Appl. No.: 10/159,974

(22) Filed: May 29, 2002

(65) Prior Publication Data

US 2003/0222731 A1 Dec. 4, 2003

(51) Int. Cl.[7] ..... H01P 1/203; H01B 12/02

(52) U.S. Cl. ..... 333/99 S; 333/202; 333/219; 505/210

(58) Field of Search ..... 333/202, 219, 333/205, 99 S, 210, 204, 134, 212, 219.1; 505/210

(56) References Cited

U.S. PATENT DOCUMENTS

| | | | | | |
|---|---|---|---|---|---|
| 4,642,591 | A | * | 2/1987 | Kobayashi | 333/227 |
| 5,078,621 | A | * | 1/1992 | Nishikawa et al. | 439/581 |
| 5,336,112 | A | * | 8/1994 | Michishita et al. | 439/581 |
| 5,638,037 | A | * | 6/1997 | Kurisu et al. | 333/202 |
| 5,708,404 | A | * | 1/1998 | Kurisu et al. | 333/202 |
| 5,786,303 | A | * | 7/1998 | Mansour | 333/99 S |

OTHER PUBLICATIONS

Schornstein, S. et al. "High Temperature Superconductor–Shielded High Power Dielectric Dual–Mode Filter for Applications In Satellite Communication" 1998 IEEE MTT–S International Microwave Symposium Digest, New York, NY, IEEE, vol. 3, pp1319–1322.*

Casinese, A. et al. "High Power Handling Superconducting Planar Filters for Telecommunication Applications" International Journal of Modern Physics 6, vol. 14, Nos. 25–27 (2000), pp. 3092–3097.

Curtis, J.A. et al., "Dual Mode Microstrip Filters", Applied Microwave, Fall 1991, pp. 56–93.

Hammond, R.B. et al., "Epitaxial T/2CaBa2Cu2O8 Thin Films With Low 9.6 GHz Surface Resistance at High Power and Above 77K", Appl. Phys. Lett. 57 (8), Aug. 20, 1990, pp. 825–827.

Hejazi, Z.M., "Compact Dual–Mode Filters for HTS Satellite Communication Systems", IEEE Microwave and Guided Wave Letters, vol. 8, No. 8, Aug. 1996, pp. 275–277.

(List continued on next page.)

*Primary Examiner*—Michael Tokar
*Assistant Examiner*—Lam T. Mai
(74) *Attorney, Agent, or Firm*—O'Melveny & Myers LLP

(57) ABSTRACT

A dual-mode resonator comprises a dielectric substrate having a region divided into four quadrants, and a ring resonator forming quadrangularly symmetrical configurations within the four quadrants of the region. The symmetrical configurations may be formed from folded sections of the resonator, so that parallel lines with opposite currents that cancel to minimize the far-field radiation of the filter structures. The symmetrical configuration can also be meandered, so that opposite currents in parallel line segments within each meander and the line segments that interconnect the meanders cancel to minimize the far-field radiation of the filter structures. One resonator can be used in a two-pole dual-mode filter structures, or multiple resonators can be used in more complex dual-mode filter structures. The filter structures also include input and output couplings with capacitors and transmission lines that directly connected to the resonator to provide a point of contact, which more accurately represent ideal lumped element capacitor connections from computer modeling.

34 Claims, 18 Drawing Sheets

OTHER PUBLICATIONS

Hong, J.S. et al., "Recent Advances in Microstrip Filters for Communications and Other Applications", IEE Colloquium on Advances in Passive Microwave Components (Ref. No. 1997/154), 1997, pp. 2/1–2/6.

Jiang, Z.F. et al., "A New HTS Microwave Filter Using Dual–Mode Multi–Zigzag Microstrip Loop Resonators", 1999 Asia Pacific Microwave Conference, vol. 3, 1999, pp. 813–816.

* cited by examiner

DUAL-MODE BANDPASS FILTER WITH DIRECT CAPACITIVE COUPLINGS AND FAR-FIELD SUPPRESSION STRUCTURES

GOVERNMENT LICENSE RIGHTS

The U.S. Government has a paid-up license in this invention and the right in limited circumstances to require the patent owner to license others on reasonable terms as provided for by the terms of Contract MDA972-00-C-0010 awarded by the Defense Advanced Research Projects Agency (DARPA).

FIELD OF THE INVENTION

The present inventions generally relate to microwave filters, and more particularly, to microwave filters designed for narrow-band applications.

BACKGROUND OF THE INVENTION

Filters have long been used in the processing of electrical signals. For example, in communications applications, such as microwave applications, it is desirable to filter out the smallest possible passband and thereby enable dividing a fixed frequency spectrum into the largest possible number of bands.

Such filters are of particular importance in the telecommunications field (microwave band). As more users desire to use the microwave band, the use of narrow-band filters will increase the actual number of users able to fit in a fixed spectrum. Of most particular importance is the frequency range from approximately 800–2,200 MHz. In the United States, the 800–900 MHz range is used for analog cellular communications. Personal communication services are used for the 1,800 to 2,200 MHz range.

Historically, filters have been fabricated using normal, that is, non-superconducting materials. These materials have inherent lossiness, and as a result, the circuits formed from them having varying degrees of loss. For resonant circuits, the loss is particularly critical. The quality factor (Q) of a device is a measure of its power dissipation or lossiness. Resonant circuits fabricated from normal metals in a microstrip or stripline configuration have Q's at best on the order of four hundred. See, e.g., F. J. Winters, et al., "High Dielectric Constant Strip Line Band Pass Filters," IEEE Transactions On Microwave. Theory and Techniques, Vol. 39, No. 12, December 1991, pp. 2182–87.

With the discovery of high temperature superconductivity in 1986, attempts have been made to fabricate electrical devices from high temperature superconductor (HTSC) materials. The microwave properties of HTSC's have improved substantially since their discovery. Epitaxial superconductive thin films are now routinely formed and commercially available. See, e.g., R. Hammond et al., "Epitaxial $Tl_2$ $Ba_2Ca_1Cu_2O_8$ Thin Films With Low 9.6 GHz Surface Resistance at High Power and Above 77° K," Applied Physics Letters, Vol. 57, pp. 825–27 (1990). Various filter structures and resonators have been formed from HTSC's. Other discrete circuits for filters in the microwave region have been described. See, e.g., S. H. Talisa, et al., "Low- and High-Temperature Superconducting Micro-wave filters," IEEE Transactions on Microwave Theory and Techniques, Vol. 39, No. 9, September 1991, pp. 1448–1554, and "High Temperature Superconductor Staggered Resonator Array Bandpass Filter," U.S. Pat. No. 5,616,538.

Currently, there are numerous applications where microstrip narrow-band filters that are as small as possible are desired. One such application involves the use of dual-mode filters (DMF's), which generate two orthogonal modes that occur at the resonant frequency. DMF's include patch dual-mode microstrip patterned structures, like circles and squares. These structures, however, take up a relatively large area on the substrate. More compact dual-mode microstrip ring structures, which occupy a smaller area on the substrate than do patch structures, have been designed.

For example, FIG. 1 shows a two-pole dual-mode filter structure 40, which includes an electrically conductive meander loop resonator 42 and a dielectric substrate 44 on which the resonator 42 is disposed. The resonator 42 includes a resonator line 46 that is formed into a loop that has a square envelope. The resonator line 46 is routed, such that it forms four arms 48, each with a single meander 50. The filter structure 40 further includes orthogonal ports 52 and 54, which are used to couple to the resonator 42. The filter structure 40 also includes a small patch 56, which is attached to an inner corner of one of the meanders 50 for perturbing the electric field pattern. As a result, a pair of degenerative modes will be coupled when either of the ports 52 and 54 is excited. The degree of coupling will depend on the size of the patch 56. Without the patch 56, no perturbation will result, and thus only the single mode will be excited. In this case, when the port 52 is used, only one of the degenerate modes will be excited, and when the other port 54 is used, the field pattern is rotated 90° for the associated degenerate mode. As illustrated, the resonator 42 generally exhibits four-quadrant symmetry to maintain orthogonality between the two degenerative modes. See J. S. Hong, "Microstrip Bandpass Filter Using Degenerate Modes of a Novel Meander Loop Resonator," IEEE Microwave and Guided Wave Letters, vol. 5, no. 11, pp. 371–372, November 1995.

As another example, FIG. 2 shows a two-pole dual-mode filter structure 60, which includes an electrically conductive meander loop resonator 62 and a dielectric substrate 64 on which the resonator 62 is disposed. The resonator 62 includes a resonator line 66 that is formed into a loop with a square envelope. The resonator line 66 is routed, such that it forms four arms 68, each with three meanders 70. The filter structure 60 further includes orthogonal fork-shaped coupling structures 72 and 74, which are distributed between the arms 68 and meanders 70. The filter structure 60 also includes a patch 76, which is attached to the inner corner of one of the meanders 70 to effect the dual-mode coupling as previously described in the filter structure 40 of FIG. 1. See, e.g., Z. M. Hejazi, "Compact Dual-Mode Filters for HTS Satellite Communication System," IEEE Microwave and Guided Wave Letters, vol. 8, no. 8, pp. 1113–1117, June 2001.

As still another example, FIG. 3 shows two-pole dual-mode filter structure 80, which includes an electrically conductive meander loop resonator 82 and a dielectric substrate 84 on which the resonator 82 is disposed. The resonator 82 is similar to the resonator 62 shown in FIG. 2, with exception that it includes a resonator line 86 that is routed, such that it forms four arms 88, each with five meanders 90. The filter-structure 80 further includes orthogonal fork-shaped coupling structures 92 and 94, which are distributed between the arms 88 and meanders 90. The filter structure 80 also includes a patch 96, which is attached to the inner corner of one of the meanders 90 to effect the dual-mode coupling as previously described in the filter structure 40 of FIG. 1. See, e.g., Z. M. Hejazi, "Compact Dual-Mode Filters for HTS Satellite Communication System," IEEE Microwave and Guided Wave Letters, vol. 8, no. 8, pp. 1113–1117, June 2001.

At lower frequencies, however, even these ring structures can become quite large, since resonance occurs when the ring is approximately a full electrical wavelength long. In addition, these ring structures do not necessarily address the problems associated with parasitic coupling, which becomes more prevalent as circuits are squeezed into smaller spaces. When coupling multiple resonators to make more complex narrow-band filters, the area required to accommodate the filter can grow undesirably large in order to minimize unwanted parasitic coupling between resonators and to test the package. This is particularly an issue for narrow bandwidth filters, where the desired coupling between resonators is very small, making the spacing between resonators greater. Thus, the overall size of the filter becomes even larger. For very high Q structures, like thin film HTS, significant Q degradation can occur due to the normal metal housing.

Another issue that arises in the design of narrow-band filter structures is the ability to accurately model these structures in the presence of unknown parameters, such as parasitic coupling and the introduction of mode exciting perturbations within the electrical field. In addition, computer models often use ideal capacitors to model the external capacitive coupling of dual-mode microstrip resonators. Because of the parasitic nature of physical capacitors, low quality, and effects of mounting, however, they often become undesirable when fabricating state-of-the-art HTS microstrip circuits. In order to eliminate the physical capacitors, the computer capacitor models are often replaced by distributed structures (i.e., by using the coupling between a length of the resonator and an input/output line running parallel to it). This replacement usually introduces degradation in frequency response, which is most noticeable in the shape and depth of the transmission zeros and poor alignment of the filter poles. This adverse effect can be seen in FIGS. 4 and 5, which plot the measured (dashed lines) and computed (solid lines) of the frequency responses for the resonators 60 and 80 illustrated in FIGS. 2 and 3. As shown, the transmission zeros are not well-defined, at least in part, because the coupling structures used to couple to these resonators act as distributed or quasi-distributed structures.

SUMMARY OF THE INVENTION

The present inventions are directed to novel dual-mode resonating filter structures. The filter structures contemplated by the present inventions may be planar structures, such as microstrip, stripline and suspended stripline. In preferred embodiments, the resonators may be composed of HTSC material. The broadest aspects of the invention, however, should not be limited to HTSC material, and contemplate the use of non-HTSC material as well.

The dual-mode resonator contemplated by the present inventions comprises a dielectric substrate having a region divided into four quadrants, and a resonator line forming quadrangularly symmetrical configurations within the four quadrants of the region. In this manner, the orthogonality of the degenerative modes is maintained. In preferred embodiments, the resonator line has a nominal length of one full-wavelength at the resonant frequency, and forms an outer envelope in the form of a square. Input and output couplings are used to couple to the resonator line, e.g., in a quadrangularly asymmetrical manner. In this manner, the orthogonal degenerative modes are excited without the use of electrical field perturbing patches.

The dual-mode resonators of the present inventions can be used as building blocks for a more complex filter structure. This complex filter structure comprises a dielectric substrate having a plurality of regions, each of which is divided into four quadrants, and a plurality of the resonators associated with the plurality of regions in the manner described above. In the preferred embodiment, an input coupling is coupled to a first one of the plurality of resonators, and an output coupling coupled to the last one of the plurality of resonators. One or more couplings can be used to interconnect the plurality of resonators.

In accordance with a first aspect of the present inventions, the quadrangularly symmetrical configurations are formed from four folded sections of the ring resonator line. The quadrangularly symmetrical configurations can be any one of a variety of configurations, e.g., a unidirectional bending configuration, spiraled configuration, or a meandering configuration. These configurations can be either rectilinear or curvilinear.

Although the present inventions should not necessarily be limited to this, these symmetrical configurations provide for a more compact structure. In addition, the electrical currents within parallel line segments of each folded section are in opposite directions. As a result, the far-field radiation is minimized, thereby allowing for tighter packing of multiple resonators and minimum performance degradation due to the tighter packaging. The minimized far-field radiation also limits the amount of energy coupled to lossy test packages thereby resulting in minimal impact to the resonator quality factor.

In accordance with a second aspect of the present inventions, each of the quadrangularly symmetrical configurations is symmetrical about an imaginary line and comprises a plurality of meanders (e.g., four, six, or more meanders) and a plurality of interconnecting segments. Each of the interconnecting segments on one side of the imaginary line is parallel to and opposes an interconnecting segment on another side of the imaginary line.

Although the present inventions should not necessarily be limited to this, the meandered configurations provide for a more compact structure. In addition, the electrical currents within parallel line segments of each meander, as well as the electrical currents within opposing interconnecting segments, are in opposite directions. As a result, the far-field radiation is minimized, thereby allowing for tighter packing of multiple resonators and minimum performance degradation due to the tighter packaging.

In accordance with a third aspect of the present inventions, input and output couplings are coupled to the resonator line, wherein one or both of the input and output couplings comprises a capacitor (e.g., an interdigitated, parallel plate, or discrete capacitor) that is coupled to the resonator line through a transmission line. The transmission line is directly connected to the resonator line to provide a point of contact with the resonator line. The input or output coupling can also have another transmission line for coupling to external circuitry. By way of non-limiting example, the first transmission line can be a narrow high impedance line, and the second transmission line can be a broad low impedance (e.g., 50 ohm) line connected to the external circuitry. Although the present inventions should not necessarily be limited by this, the direct coupling of the capacitor to the resonator line more accurately represent ideal lumped element capacitor connections from the computer modeling than do distributed coupling structures. If the filter structure comprises a plurality of resonator lines, one or more couplings can interconnect the plurality of resonator lines. Each of these interconnecting couplings can include a common coupling segment, first and second capacitors respectively coupled to the ends of the common coupling segment, and first and second transmission line segments directly connected to the respective resonant lines. In this manner, the resonator lines are coupled together at points of contact, rather than in a distributed capacitive manner between the lengths of the resonators.

BRIEF DESCRIPTION OF THE DRAWINGS

The drawings illustrate the design and utility of preferred embodiments of the present invention, in which similar elements are referred to by common reference numerals. In order to better appreciate how the above-recited and other advantages and objects of the present inventions are obtained, a more particular description of the present inventions briefly described above will be rendered by reference to specific embodiments thereof, which are illustrated in the accompanying drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

Figure 1:
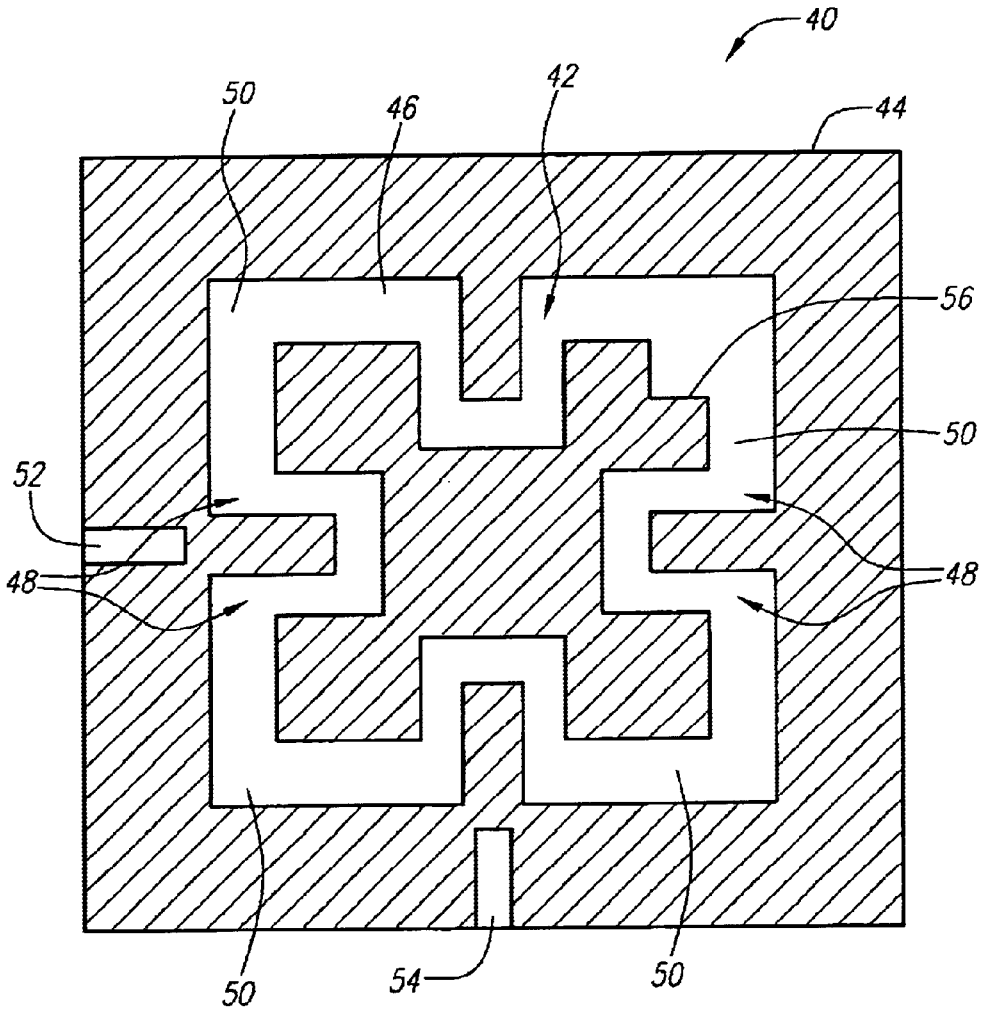
FIG. 1 illustrates a prior art two-pole dual-mode filter structure having four arms, each of which have one meander.
Figure 2:
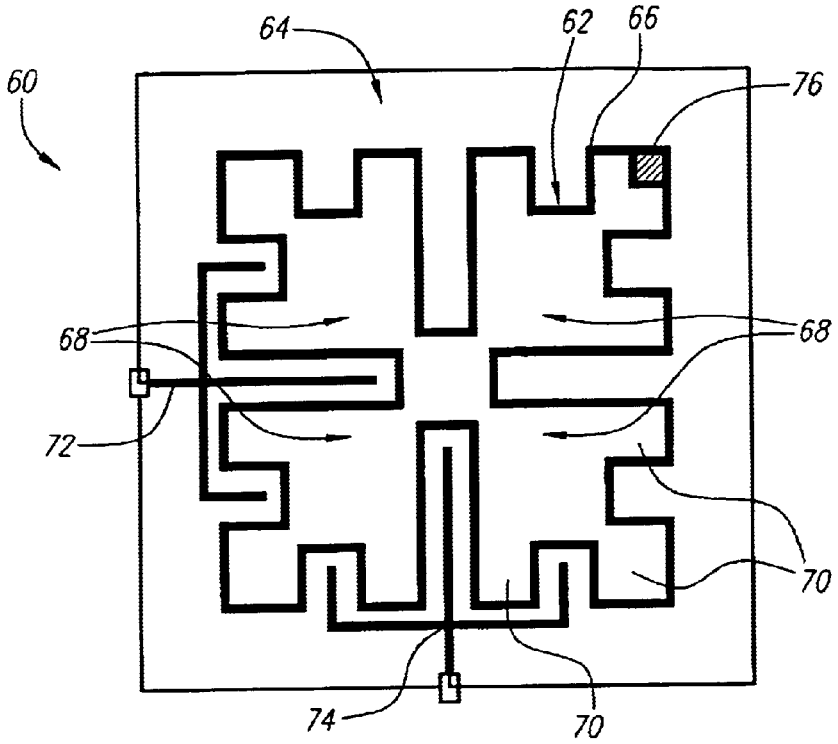
FIG. 2 illustrates another prior art two-pole dual-mode filter structure having four arms, each of which have three meanders.
Figure 3:
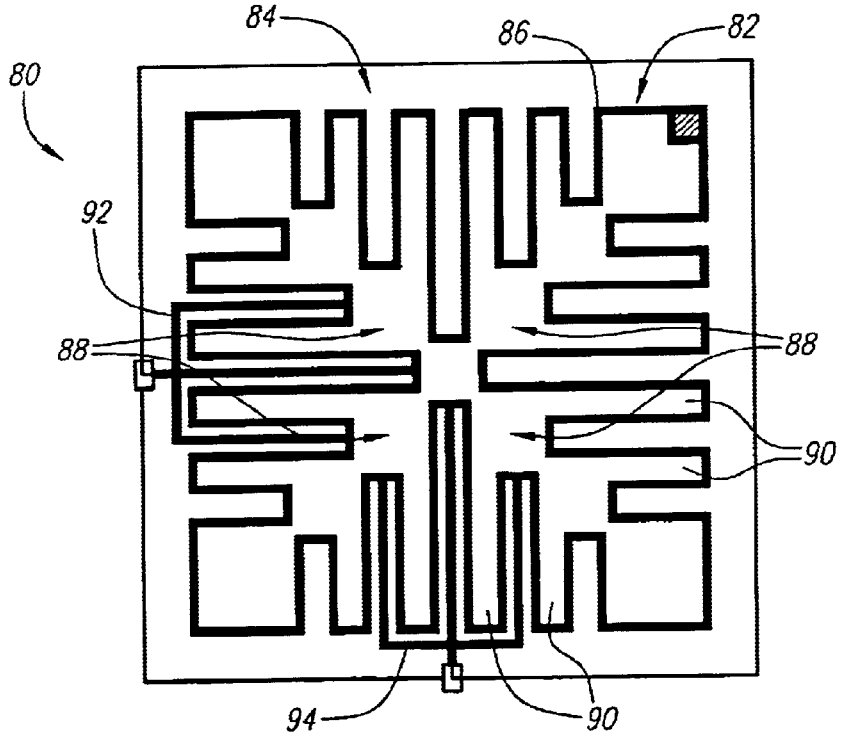
FIG. 3 illustrates another prior art two-pole dual-mode filter structure having four arms, each of which have five meanders.
Figure 4:
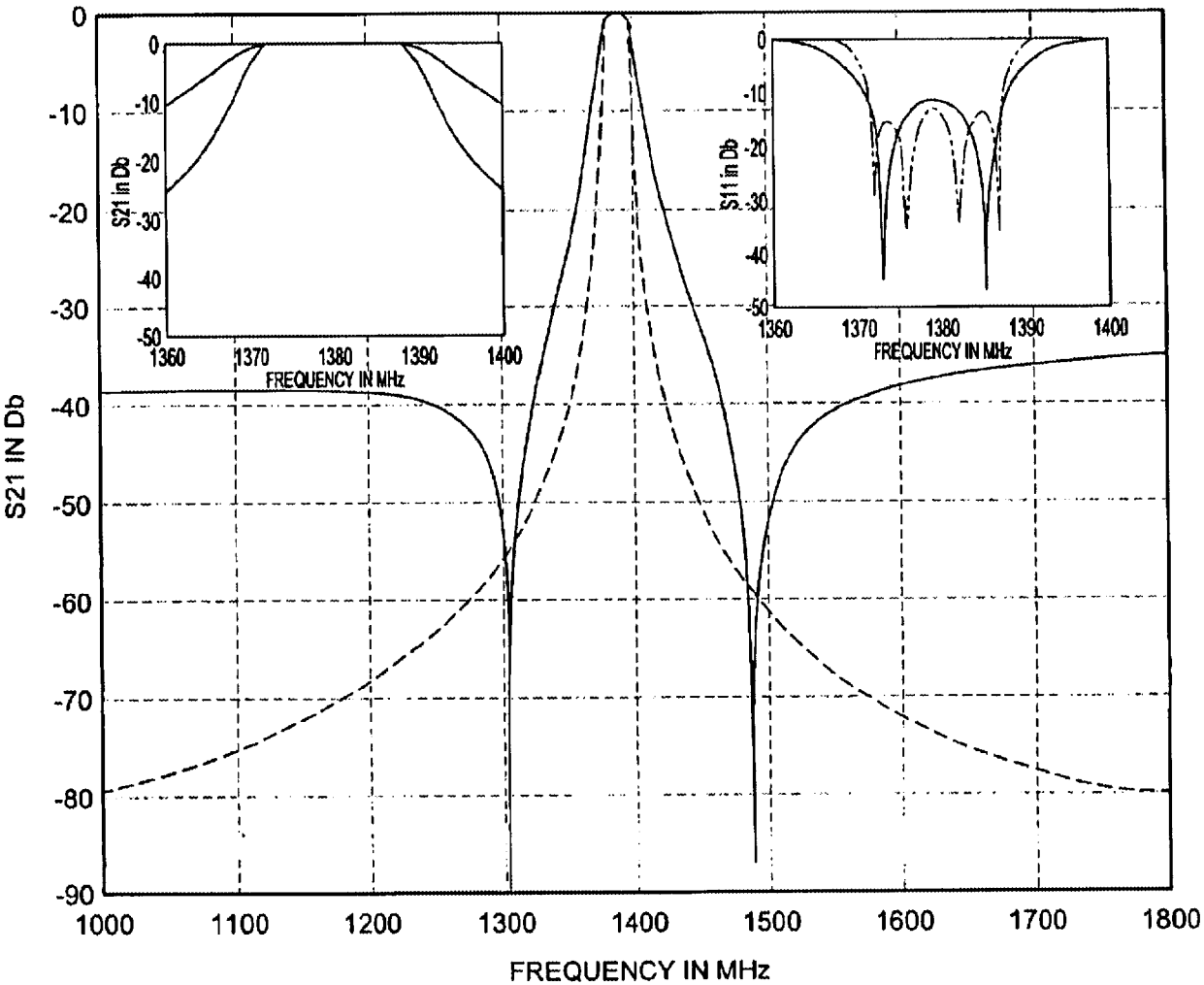
FIG. 4 illustrates the measured and computed frequency responses of the filter structure of FIG. 2.
Figure 5:
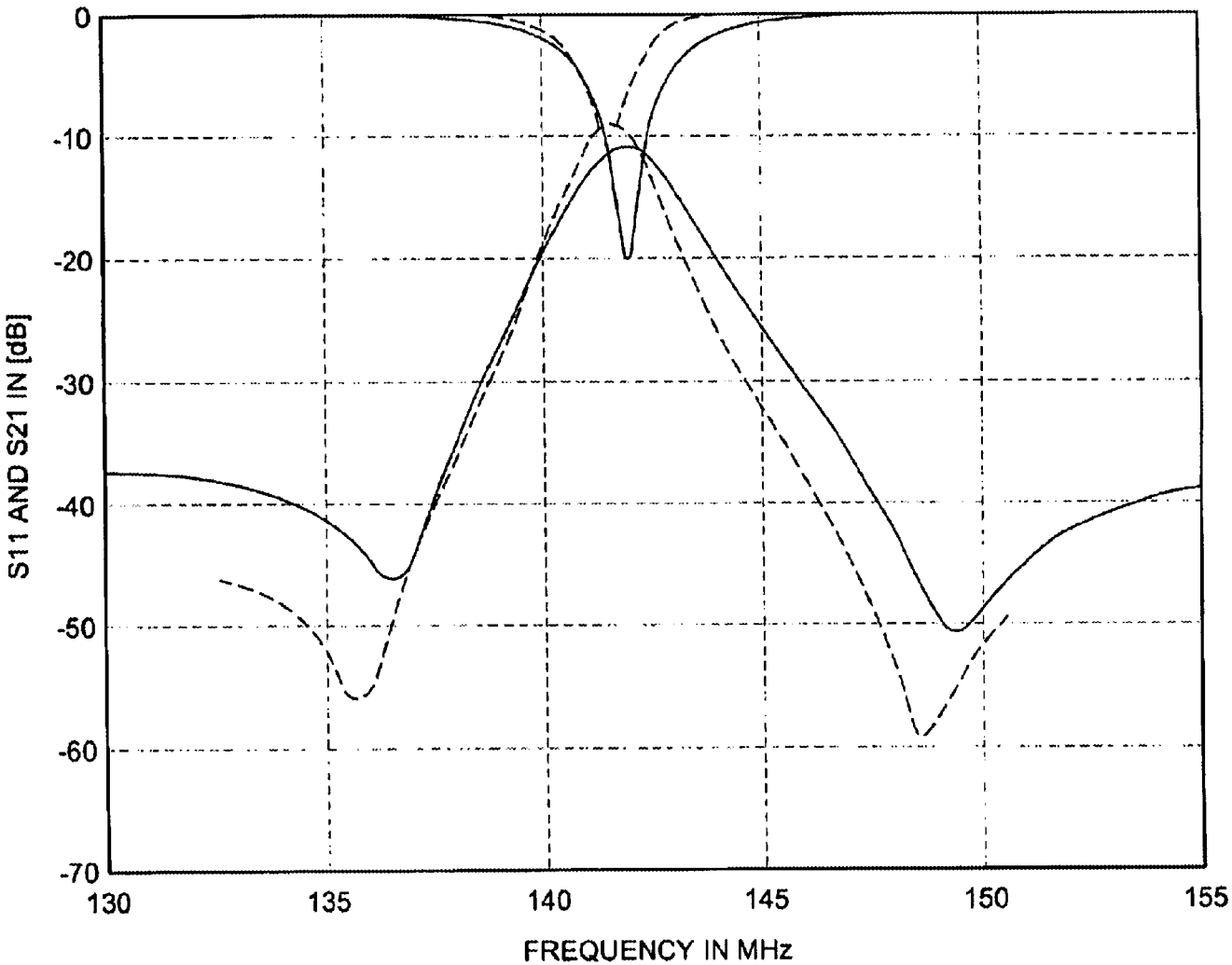
FIG. 5 illustrates the measured and computed frequency responses of the filter structure of FIG. 3.
Figure 6:
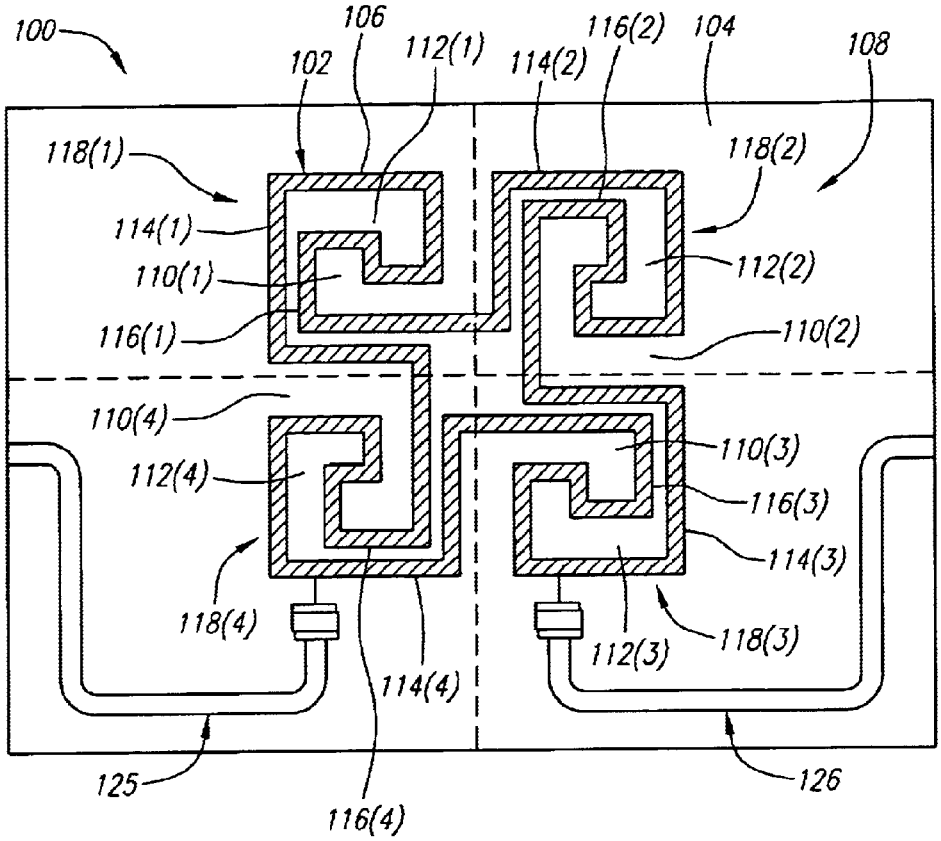
FIG. 6 illustrates a two-pole dual-mode folded filter structure constructed in accordance with one preferred embodiment of the present inventions, wherein each folded section is arranged to form a quadrangularly symmetrical rectilinear bending configuration.

Referring to FIG. 6, a two-pole dual-mode folded filter structure 100 constructed in accordance with one preferred embodiment of the present inventions will now be described. The folded filter structure 100 generally comprises a folded ring resonator 102 and a substrate 104 with a region 108 on which the resonator 102 is disposed. In the illustrated embodiment, the folded filter structure 100 is formed using microstrip. The resonator 102 is composed of a suitable HTS material, and the substrate 104 is composed of a suitable dielectric material.

The resonator 102 comprises a resonator line 106, which in the illustrated embodiment, has a nominal length of one full wavelength at the resonant frequency. The region 108 is divided into four imaginary quadrants 110(1)–(4), and the resonator line 106 is arranged with respect to these imaginary quadrants 110 to maintain orthogonality between the two degenerative modes, while minimizing the space occupied by the resonator 102, as well as the far-field radiation generated by the resonator 102.

Figure 7:
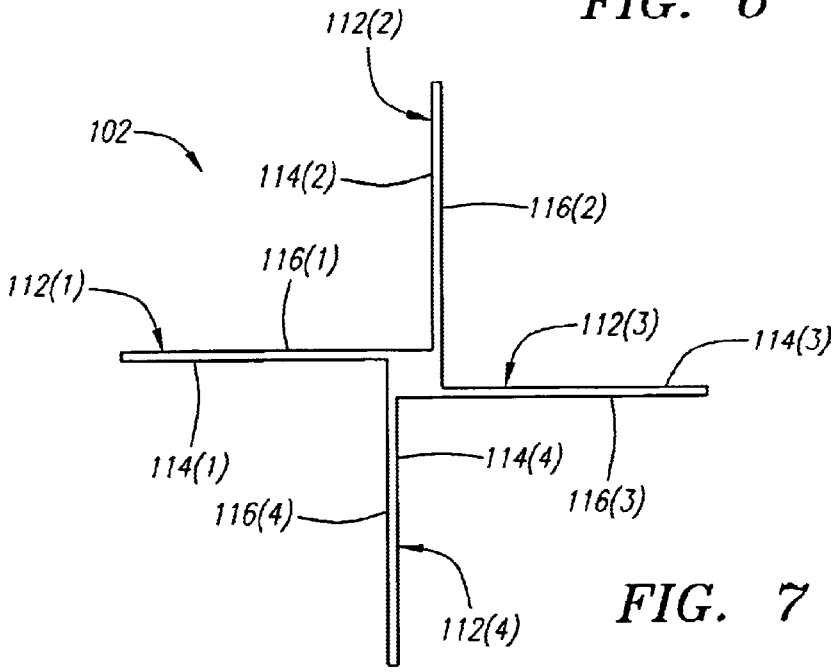
FIG. 7 illustrates the folded sections of the ring resonator used in the filter structure of FIG. 6 prior to arranging them into the rectilinear bending configuration.

Specifically, the resonator line 106 comprises a four folded sections 112(1)–(4), each characterized by a pair of generally parallel line segments 114 and 116, as illustrated in FIG. 7. These four folded sections 112 are arranged to respectively form four quadrangularly symmetrical configurations 118(1)–(4). For the purposes of this specification, the term "quadrangularly symmetrical" means that the configuration of the resonator line 106 in all four quadrants 110 are generally the same as seen from a center 120 of the region 108. This feature helps maintain well-defined transmission zeros within the frequency response. In the embodiment illustrated in FIG. 6, the symmetrical configurations 118 are characterized as rectilinear unidirectional bending configurations.

Figure 8:
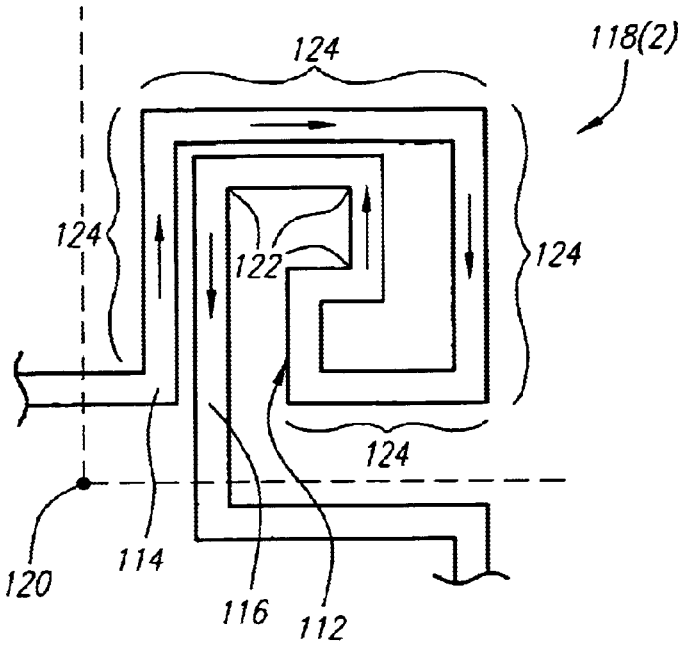
FIG. 8 illustrates a close-up of one of the rectilinear bending configurations of the filter structure of FIG. 6.

Specifically referring to FIG. 8, each folded section 112 (shown as folded section 112(2) in FIG. 7) is bent in the same direction at angles 122 (here, 90 degrees) to form a plurality of rectilinear segments 124. In general, the more times the folded section 112 is bend, the more compact the resonator 102 will be. In the illustrated embodiment, the folded section 112 is bent three times at 90 degree angles to effect a 270 degree bending configuration. It should be noted, however, that the folded section 112 can have less bends to effect a lesser bending configuration, e.g., two bends for a 180 degree bending configuration, or can have more bends to effect a greater bending configuration, e.g., four bends for a 360 degree bending configuration.

Thus, the bending configurations 118 reduce the footprint of the resonator 102. In addition, since the electrical currents in the adjacent parallel line segments 114 and 116 of each folded section 112 are in the opposite directions (as illustrated in FIG. 7), far-field radiation is minimized, thereby allowing for tighter packing of multiple resonators and minimum performance degradation due to the tighter packaging. Another feature provided by the resonator 102 is that its electrical field is localized within each of the bending configurations 118. As a result, the two degenerate modes can be tuned nearly independently by positioning tuning elements over adjacent quadrants 110 of the region 108 where the peak electrical fields are located. This tuning can be done using low loss dielectric rotors in order to preserve the quality factor of the resonator 102.

Figure 9:
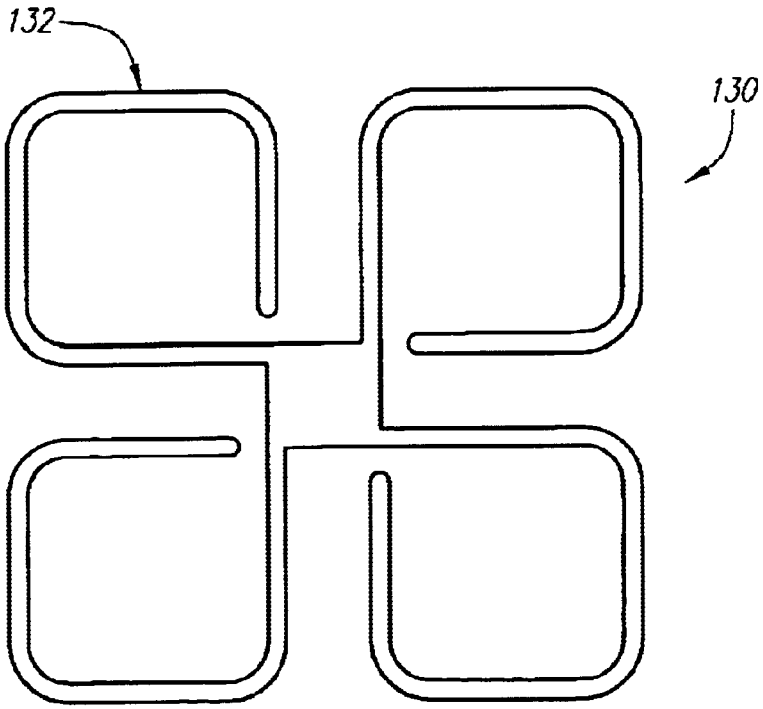
FIG. 9 illustrates another folded ring resonator that can be used by the filter structure of FIG. 6, wherein the folded sections are arranged in quadrangularly symmetrical curvilinear bending configurations.
Figure 10:
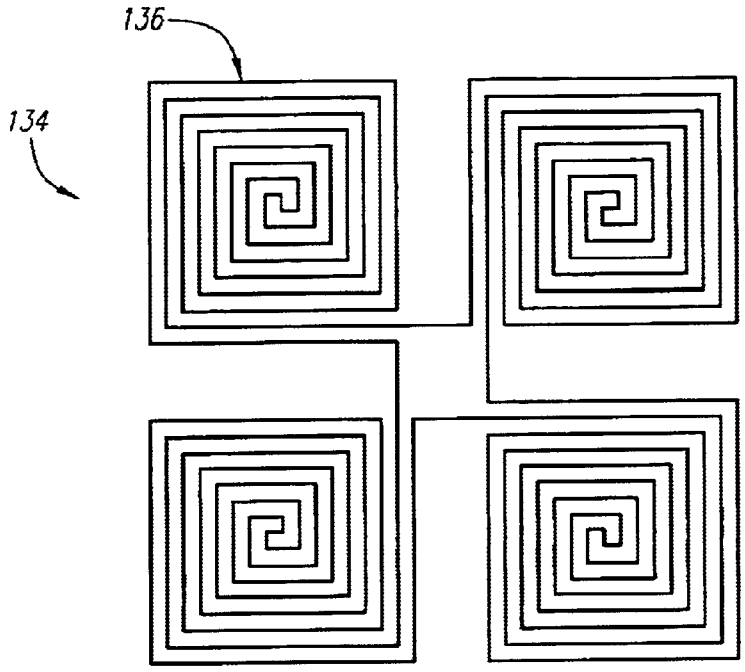
FIG. 10 illustrates another folded ring resonator that can be used by the filter structure of FIG. 6, wherein the folded sections are arranged in quadrangularly symmetrical rectilinear spiraling configurations.
Figure 11:
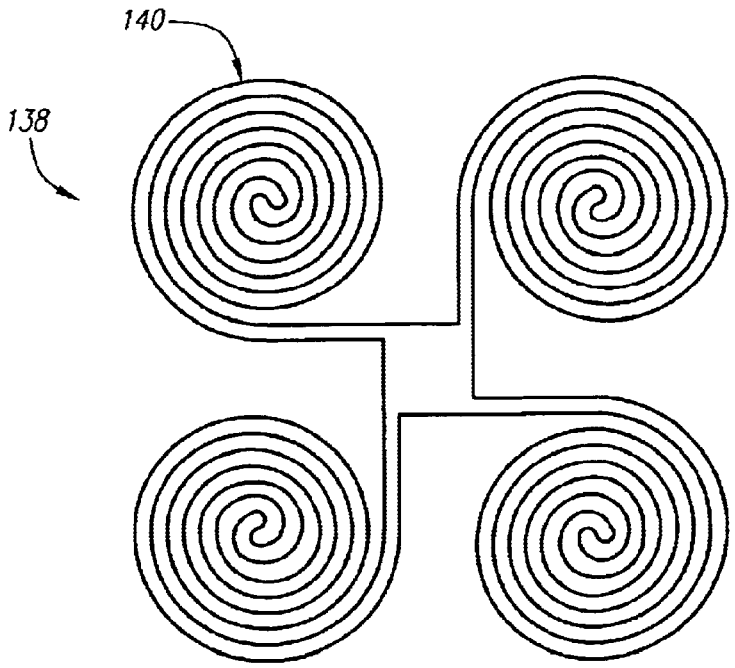
FIG. 11 illustrates another folded ring resonator that can be used by the filter structure of FIG. 6, wherein the folded sections are arranged in quadrangularly symmetrical curvilinear spiraling configurations.
Figure 12:
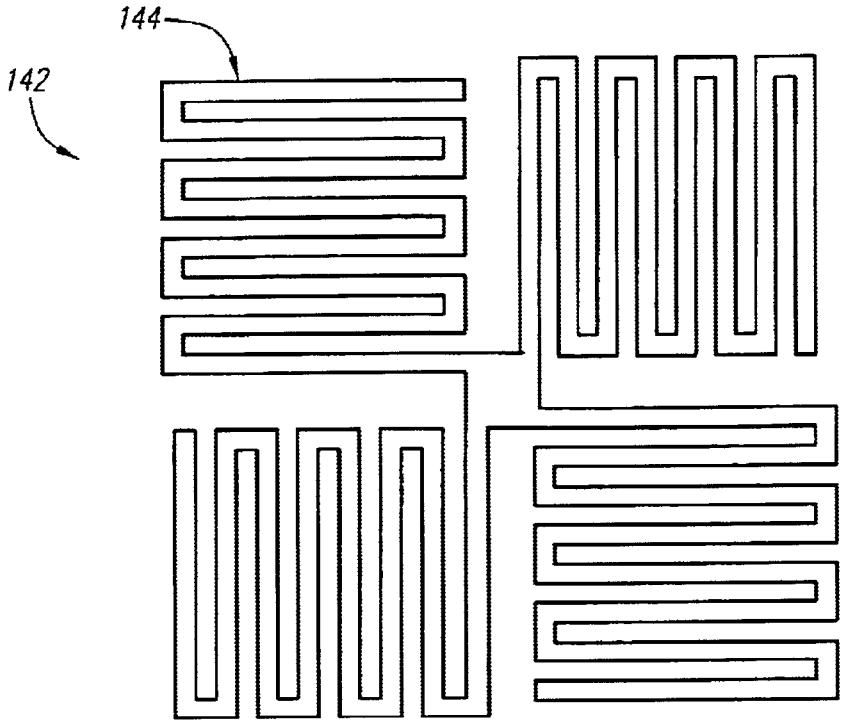
FIG. 12 illustrates another folded ring resonator that can be used by the filter structure of FIG. 6, wherein the folded sections are arranged in quadrangularly symmetrical rectilinear meandering configurations.
Figure 13:
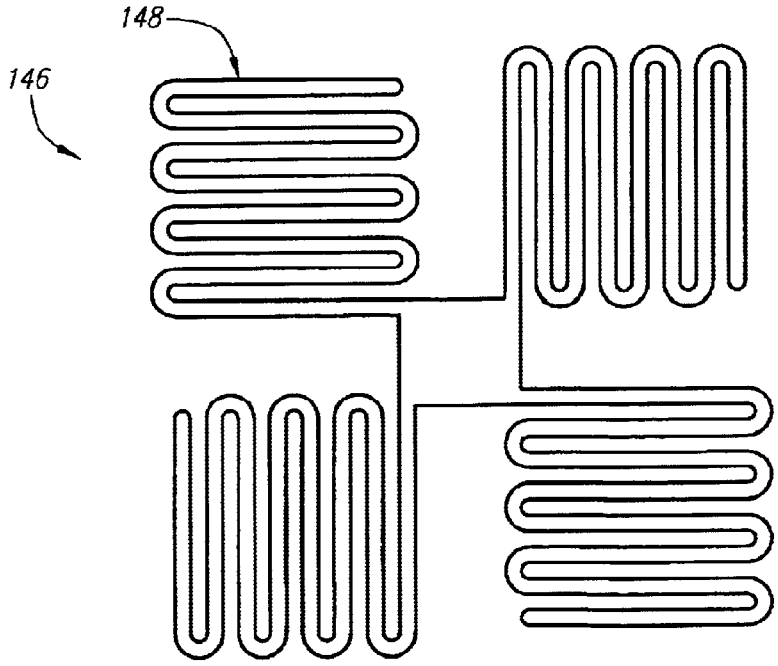
FIG. 13 illustrates another folded ring resonator that can be used by the filter structure of FIG. 6, wherein the folded sections are arranged in quadrangularly symmetrical curvilinear meandering configurations.

The folded sections 112 of the resonator line 106 can be arranged into other types of quadrangularly symmetrical configurations. For example, FIG. 9 illustrates a folded filter structure 130 wherein the folded sections 112 are respectively arranged into 270 degree curvilinear unidirectional bending configurations 132. FIG. 10 illustrates a folded filter structure 134 wherein the folded sections 112 are respectively arranged into rectilinear spiraling configurations 136. FIG. 11 illustrates a folded filter structure 138 wherein the folded sections 112 are respectively arranged into curvilinear spiraling configurations 140. FIG. 12 illustrates a folded filter structure 142 wherein the folded sections 112 are respectively arranged into rectilinear meandering configurations 144. FIG. 13 illustrates a folded filter structure 146 wherein the folded sections 112 are respectively arranged into curvilinear meandering configurations 148.

Referring back to FIG. 6, input and output couplings 125 and 126 are coupled to the resonator 102. Specifically, the input coupling 125 is coupled to the portion of the resonator 102 at the bottom of quadrant 110(4), and the output coupling 126 is coupled to the portion of the resonator 102 at the bottom of quadrant 110(3). The tap locations of the couplings 125/126 play a key role in coupling to the orthogonal modes of the resonator 102 as well as defining the transmission zeros. As can be seen, the couplings 125/126 are coupled to the resonator 102 in a quadrangularly asymmetrical manner, so that the orthogonal degenerate modes are excited within the electrical field generated by the resonator 102. Thus, no patches are required to be placed within the resonator 102 to perturb the electrical field.

Figure 14:
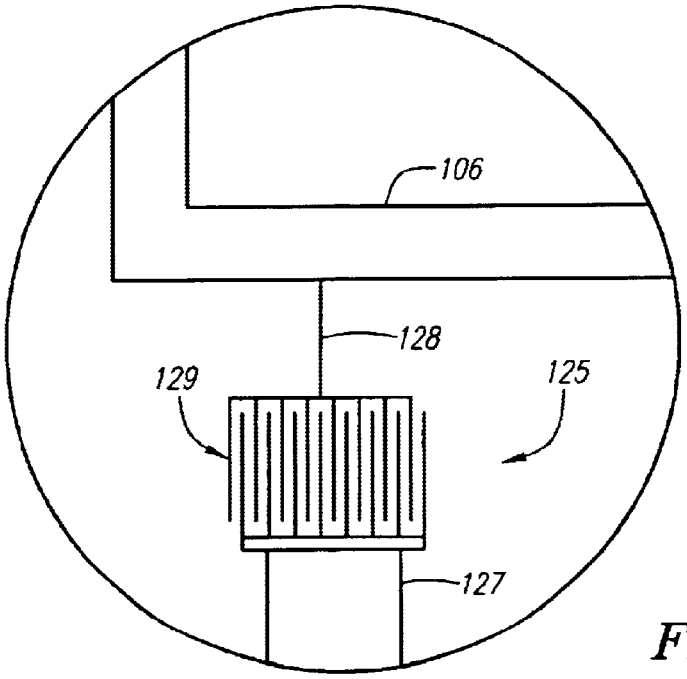
FIG. 14 illustrates a close-up of one of the interdigitated couplings used in the filter structure of FIG. 6.

The couplings 125/126 advantageously use capacitive couplings that are directly connected to the resonator 102, which more accurately represent ideal lumped element capacitor connections from the computer modeling than do distributed coupling structures. As best shown in FIG. 14, the input coupling 125 comprises first and second transmission line segments 127 and 128, and a capacitor 129 (in this case, an interdigitated capacitor) formed therebetween. Other types of capacitors can also be used, such as discrete or parallel plate capacitors. In the illustrated embodiment, the first transmission line segment 127 is a broad low impedance transmission line (in the illustrated embodiment 50 ohms) that connects to the external circuitry, and the second transmission line segment 128 is a narrow high impedance transmission line that is directly connected to the resonator 102, thereby acting as a point of contact. The output coupling 126 similarly includes two transmission line segments and an interdigitated capacitor.

Figure 15:
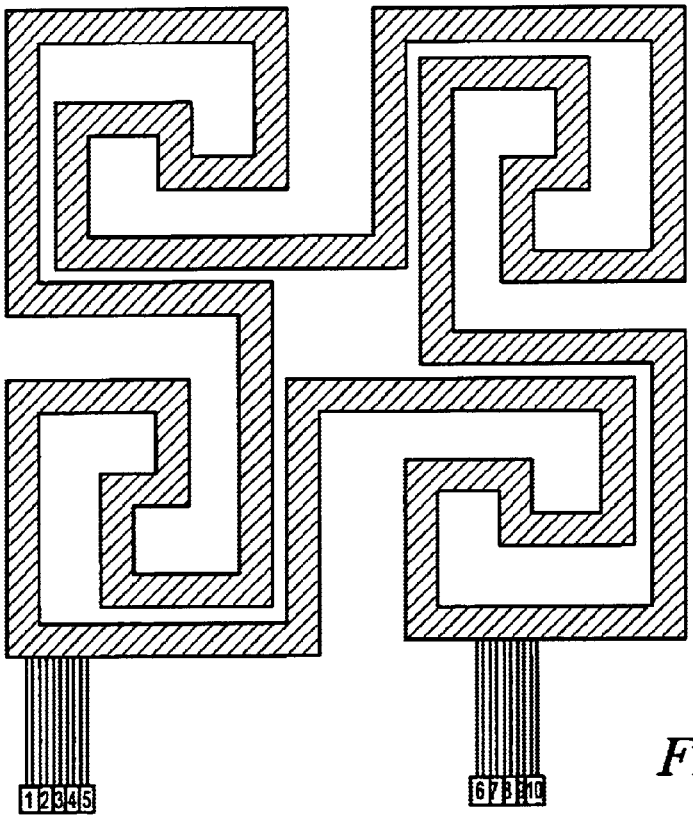
FIG. 15 illustrates a computer simulated filter structure designed in accordance with the filter structure of FIG. 6.

By way of non-limiting example, an actual embodiment of a two-pole dual-mode folded filter structure was modeled and fabricated in accordance with the folded filter structure 100 illustrated in FIG. 6. The resonator was composed of an epitaxial $Tl_2\ Ba_2Ca_1Cu_2O_8$ thin film, and the substrate was composed of 20 mil thick Magnesium Oxide material ($e_r$= 9.7). Using a full-wave electromagnetic simulator, specifically SONNET software, the filter structure was modeled with ten de-embedded tap points (as illustrated in FIG. 15) to create a multi-port network. This network was then used in a 2-pole lumped element model in a proprietary linear circuit analysis program to determine the coupling values needed to produce the desired frequency response. Other standard linear circuit analysis programs can be used as well. With the ideal coupling values known, the SONNET software was used again to create a 2-port network that represents the interdigitated coupling sections. This network was then used in the linear circuit analysis program to generate the final computed frequency response of the filter structure.

Figure 16:
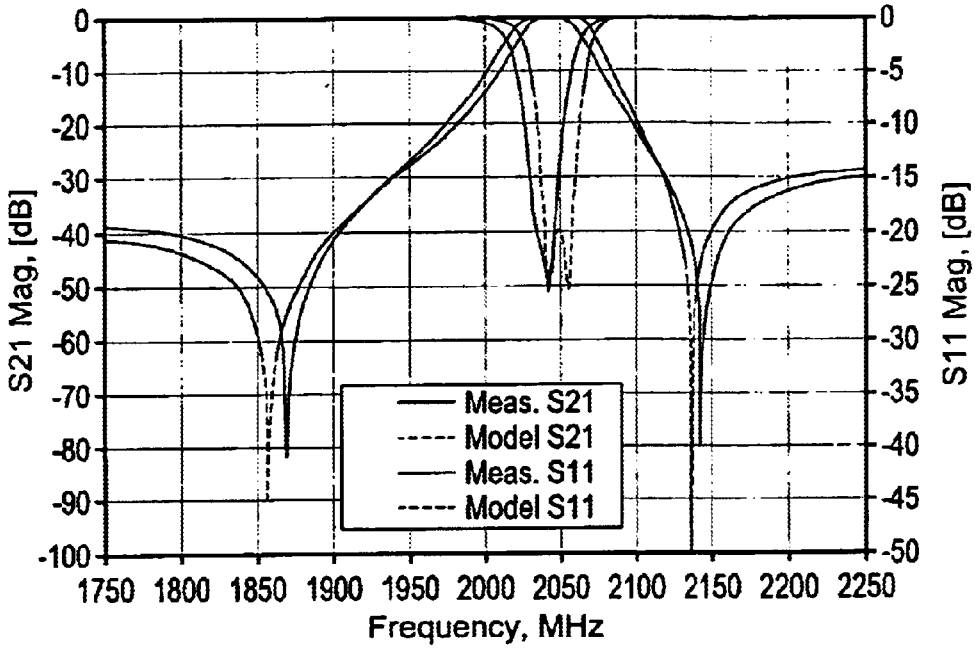
FIG. 16 illustrates the measured and computed frequency responses of a filter structure fabricated in accordance with the filter structure of FIG. 6.

FIG. 16 shows the passband response of both the modeled and fabricated two-pole dual-mode folded filter structure, with the dashed lines representing the response computed using the linear circuit analysis software incorporating the Sonnet networks, and the solid lines representing the response measured at 77° K. As can be seen, there is very good agreement between the measured and modeled responses. The well-defined transmission zeros illustrated in FIG. 16 are a result of the implementation of the coupling technique and the four-quadrant symmetrical layout. In order to measure the unloaded quality factor (Q) of the dual-mode resonator, the input and output couplings were greatly decoupled, allowing the natural modes of the resonator to be measured. This was accomplished by scribing away part of the input and output transmission lines. The measured unloaded Q at 77° K and 2.14 GHz was approximately 36,000, which included the effects of the normal metal package and lid.

Figure 17:
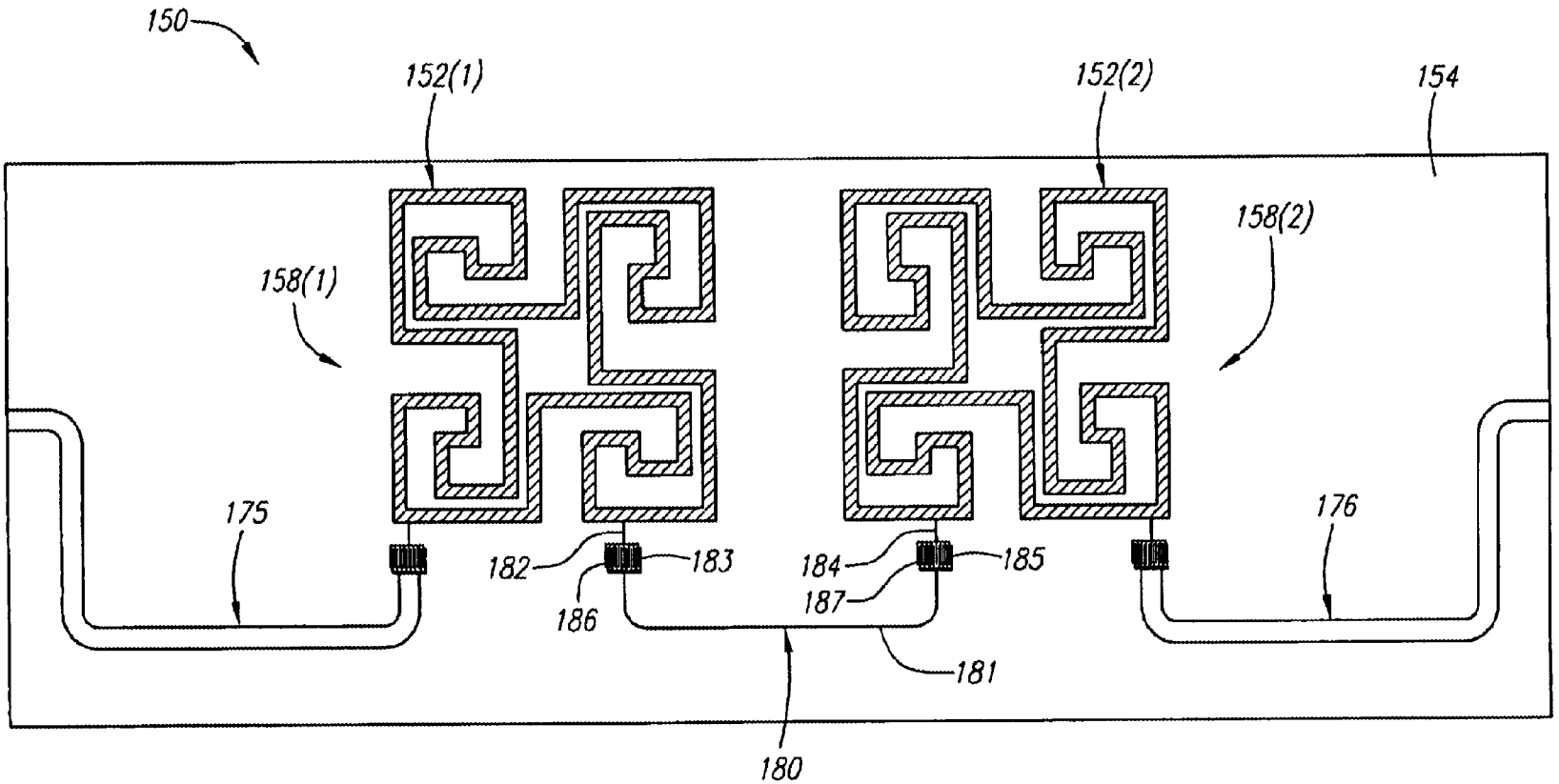
FIG. 17 illustrates a four-pole dual-mode folded filter structure constructed in accordance with another preferred embodiment of the present inventions, wherein two folded ring resonators similar to those used in the filter structure of FIG. 6 are used.

The dual-mode resonator of FIGS. 6 and 9–13 are building blocks that can be utilized to create more complex filters. Referring now to FIG. 17, a four-pole dual-mode folded filter structure 150 constructed in accordance with another preferred embodiment of the present inventions will now be described. The folded filter structure 150 generally comprises two folded ring resonators 152(1) and 152(2) and a substrate 154, which has two regions 158(1) and 158(2) on which the two resonators 152 are respectively disposed. The composition and configuration of the resonators 152 and substrate 154 are identical to the previously discussed resonator 102 and substrate 104, and thus, will not be described in further detail. Although the resonators 152 use rectilinear bending configurations 118 as shown, they can use other types of symmetrical configurations, such as the symmetrical configurations illustrated in FIGS. 9–13.

Input and output couplings 175 and 176, which are similar to the previously described input and output couplings 125 and 126, are respectively coupled to the resonators 152(1) and 152(2). In the illustrated embodiment, rather than coupling the resonators 152 by placing them in a relatively close relationship, which would result in a distributed capacitance, an interconnecting coupling 180 is coupled between the two resonators 152 to provide for a point capacitance. To this end, the interconnecting coupling 180 includes interdigitated capacitors to more accurately represent ideal lumped element capacitor connections from the computer modeling. Specifically, the interconnecting coupling 180 comprises a common high impedance transmission line segment 181, a first high impedance transmission line segment 182 that is coupled to end of the common transmission line segment 181 via an interdigitated capacitor 183, and a second high impedance transmission line segment 184 that is coupled to the other end of the common transmission line segment 181 via another interdigitated capacitor 185. The high impedance transmission line segments 182 and 184 are directly connected to the resonators 152(1) and 152(2), thereby acting as points of contact. The interconnecting coupling 180 further comprises shunt capacitance structures 186 and 187 to provide additional shunt capacitance to the interconnecting coupling 180.

Figure 18:
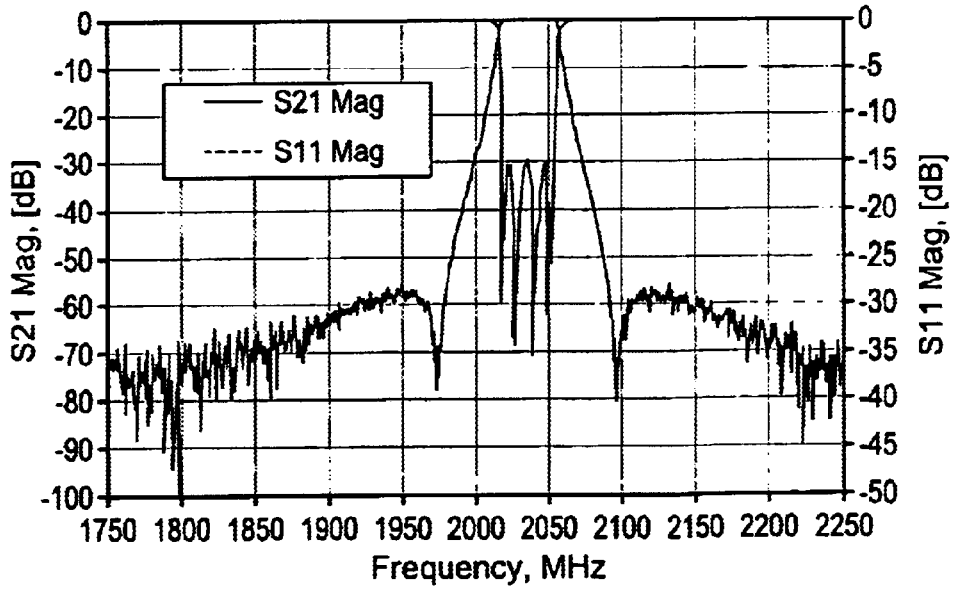
FIG. 18 illustrates the measured frequency responses of a filter structure fabricated in accordance with the filter structure of FIG. 17.

By way of non-limiting example, an actual embodiment of a four-pole dual-mode folded filter structure was modeled and fabricated in accordance with the folded filter structure 150 illustrated in FIG. 17. This filter structure was composed of the same material and modeled in the same manner as the fabricated two-pole folded filter structure. FIG. 18 shows the measured passband response of the fabricated four-pole dual-mode folded filter structure. As shown, the well-defined poles are, again, a result of the implementation of the coupling technique and four-quadrant symmetry layout.

Figure 19:
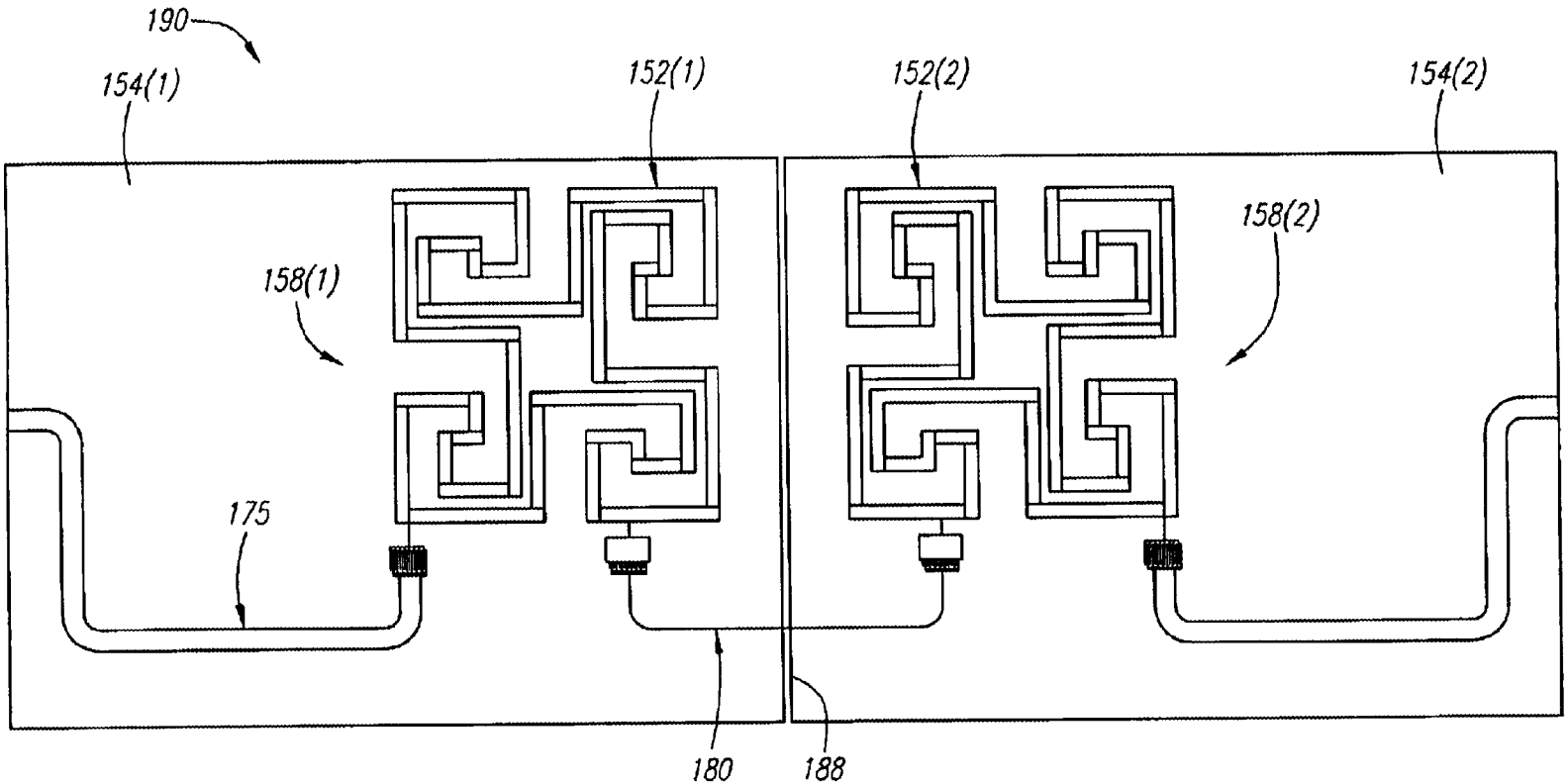
FIG. 19 illustrates a four-pole dual-mode folded filter structure similar to the filter structure of FIG. 17, wherein two substrates are used.

It should be noted that the resonators of a four-pole dual-mode folded filter structure need not be disposed on a single substrate. For example, FIG. 19 shows a filter structure 190, wherein the two resonators 152(1) and 152(2) disposed on two regions 158(1) and 158(2) located on separate substrates 154(1) and 154(2). A jumper 188 is used to interconnect the portions of the interconnecting coupling 180 residing on the respective substrates 154(1) and 154(2).

Figure 20:
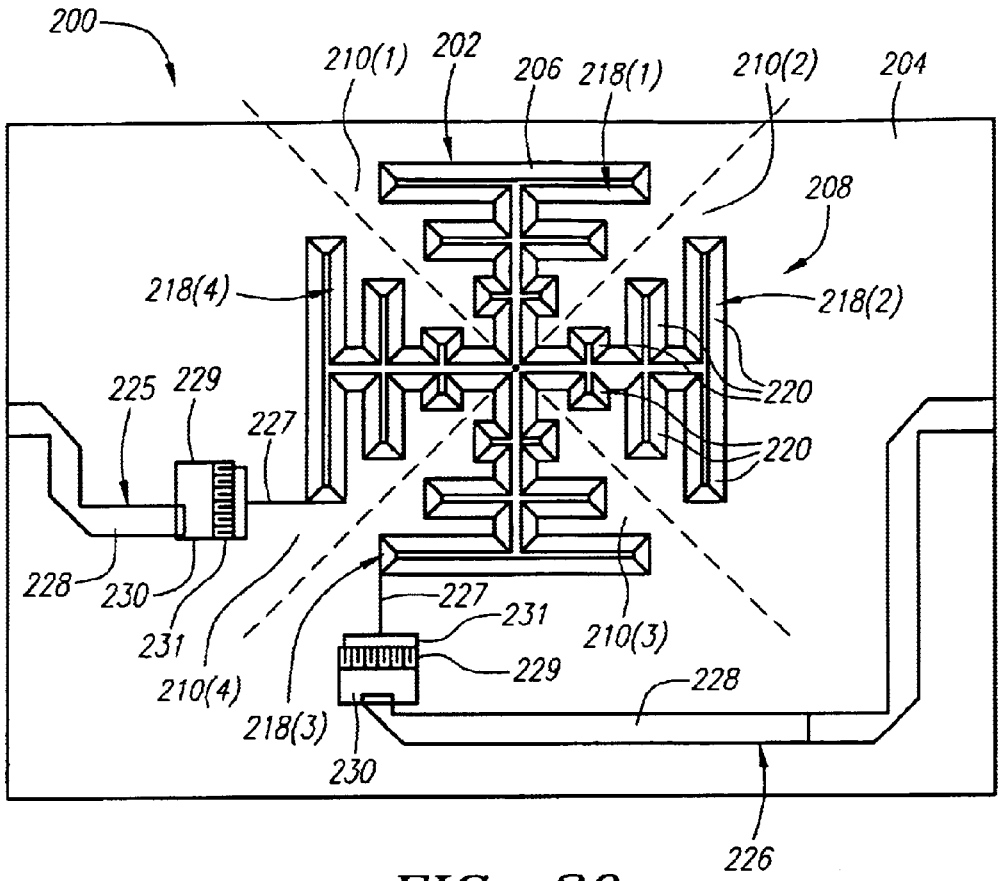
FIG. 20 illustrates a two-pole dual-mode meandered filter structure constructed in accordance with still another preferred embodiment of the present inventions, wherein each quadrangularly meandering configuration is formed with six meanders.

Referring to FIG. 20, a two-pole dual-mode meandered filter structure 200 constructed in accordance with another preferred embodiment of the present inventions will now be described. The meandered filter structure 200 generally comprises a meandered ring resonator 202 and a substrate 204 with a region 208 on which the resonator 202 is disposed. In the illustrated embodiment, the meandered filter structure 200 is formed using microstrip. The resonator 202 is composed of a suitable HTS material, and the substrate 204 is composed of a suitable dielectric material.

The resonator 202 comprises a resonator line 206, which in the illustrated embodiment, has a nominal length of one full wavelength at the resonant frequency. The region 208 is divided into four imaginary quadrants 210(1)–(4), and the resonator line 206 is arranged with respect to these imaginary quadrants 210 to maintain orthogonality between the two degenerative modes, while minimizing the space occupied by the resonator 202, as well as the far-field radiation generated by the resonator 202.

Specifically, the resonator line 206 arranged to form four meandered quadrangularly symmetrical configurations 218 (1)–(4). As with the previously described resonator line 106, this feature helps maintain well-defined transmission zeros within the frequency response. The resonator line 206 is placed into the meandered configurations in that, for each quadrant 210, there exists a plurality of meanders 220 (in this case, six meanders).

Figure 21:
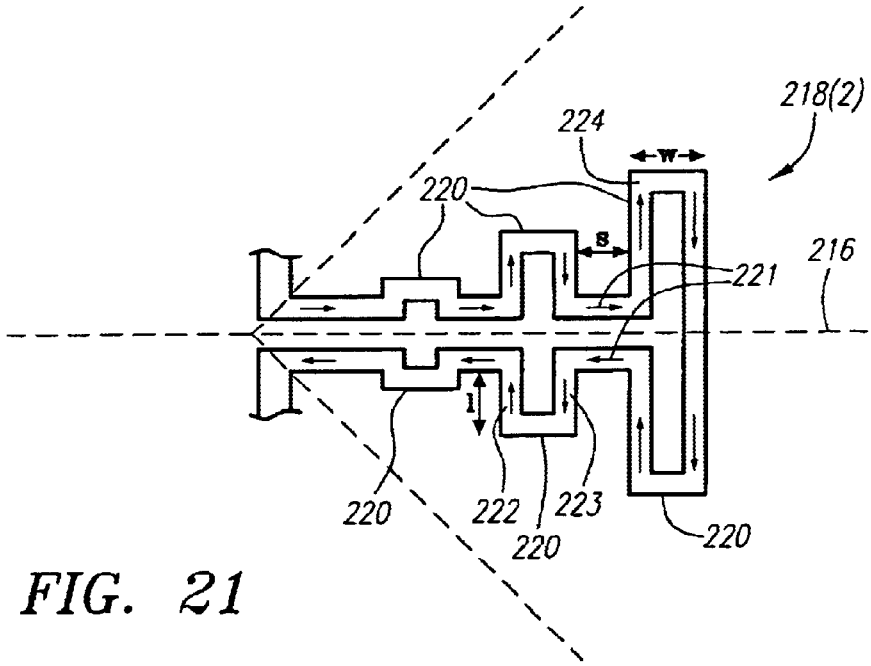
FIG. 21 illustrates a close-up of one of the meandered configurations of the filter structure of FIG. 13.

Specifically referring to FIG. 21, the meandered configuration 218 (shown as meandered configuration 218(2)) comprises a plurality of meanders 220 that are spaced from each other via interconnecting line segments 221 (which define a spacing s). Each meander 220 extends in a direction perpendicular to the imaginary line of symmetry 216. Each meander 220 comprises parallel line segments 222 and 223 (which define a length l of the meander) that are interconnected via line segments 224 (which define a width w of the meander). In the illustrated embodiment, the lengths l of the meanders 220 gradually increase along the length of the meandered configuration 218.

Thus, it can be seen that the meandered configurations 218 reduce the footprint of the resonator 202. Like with the previously described folded configuration 118, the two degenerate modes can be tuned nearly independently by positioning tuning elements over adjacent quadrants 210 of the region 208 where the peak electrical fields are located. In addition, since the electrical currents between adjacent parallel line segments 222/223 of each meander 220 are in the opposite directions, far-field radiation is minimized, thereby allowing for tighter packing of multiple resonators 202 and minimum performance degradation due to the tighter packaging.

To enhance this electrical current canceling effect, the electrical current between any given interconnecting line segment 221 is in a direction opposite to that of the electrical current between an adjacent interconnecting line segment 221. To ensure that this occurs, the meandering configuration 218 is symmetrical about an imaginary line 216, so that the interconnecting segments 221 disposed along one side of the imaginary line 216 are parallel to and oppose interconnecting segments 221 disposed along the other side of the imaginary line 216. Thus, the directions of the electrical currents in any opposing pair of interconnecting segments 221 are opposite, and thus cancel each other.

Referring back to FIG. 20, input and output couplings 225 and 226 are coupled to the resonator 202. Specifically, the input coupling 225 is coupled to the portion of the resonator 202 in quadrant 210(4), and the output coupling 226 is coupled to the portion of the resonator 202 quadrant 210(3). Like the couplings 125/126 of the folded filter structure 100, the tap locations of the couplings 225/226 play a key role in coupling to the orthogonal modes of the resonator 202 as well as defining the transmission zeros, and are coupled to the resonator 202 in a quadrangularly asymmetrical manner. As a result, the orthogonal degenerate modes are excited within the electrical field generated by the resonator 202, and thus, no patches are required to be placed within the resonator 202 to perturb the electrical field. Like-the couplings 125/126 of the folded filter structure 100, each of the couplings 225/226 comprises first and second transmission line segments 227 and 228, and an interdigitated capacitor 229 formed therebetween. The first transmission line segment 227 is low impedance transmission line, and the second transmission line segment 228 is a high impedance transmission line that is directly connected to the resonator 202 to provide a point of contact. The couplings 225/226 further comprise additional shunt capacitance structures 230 and 231 on opposing sides of the interdigitated capacitors 229 to provide the proper susceptance values for the couplings 225/226.

Figure 22:
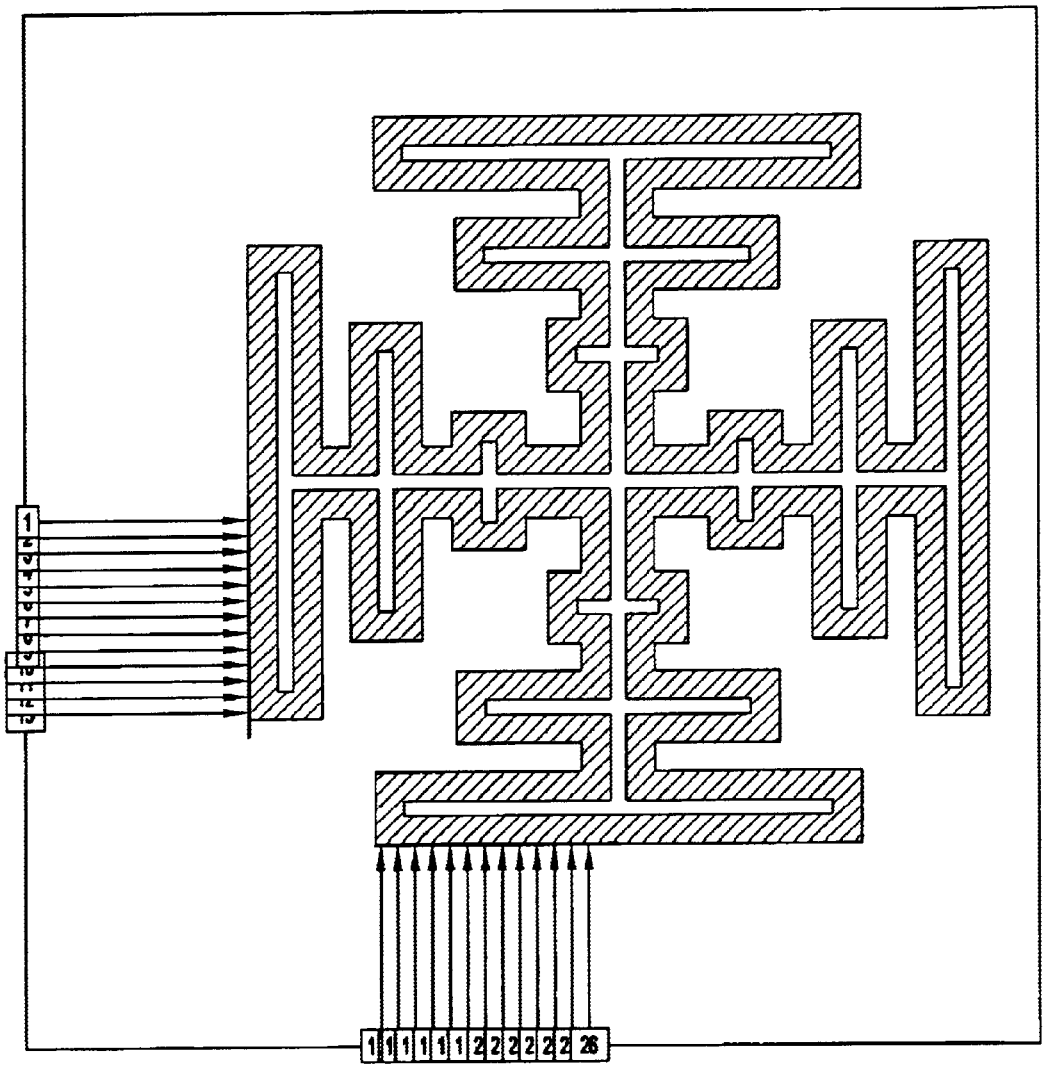
FIG. 22 illustrates a computer simulated filter structure designed in accordance with the filter structure of FIG. 21.
Figure 23:
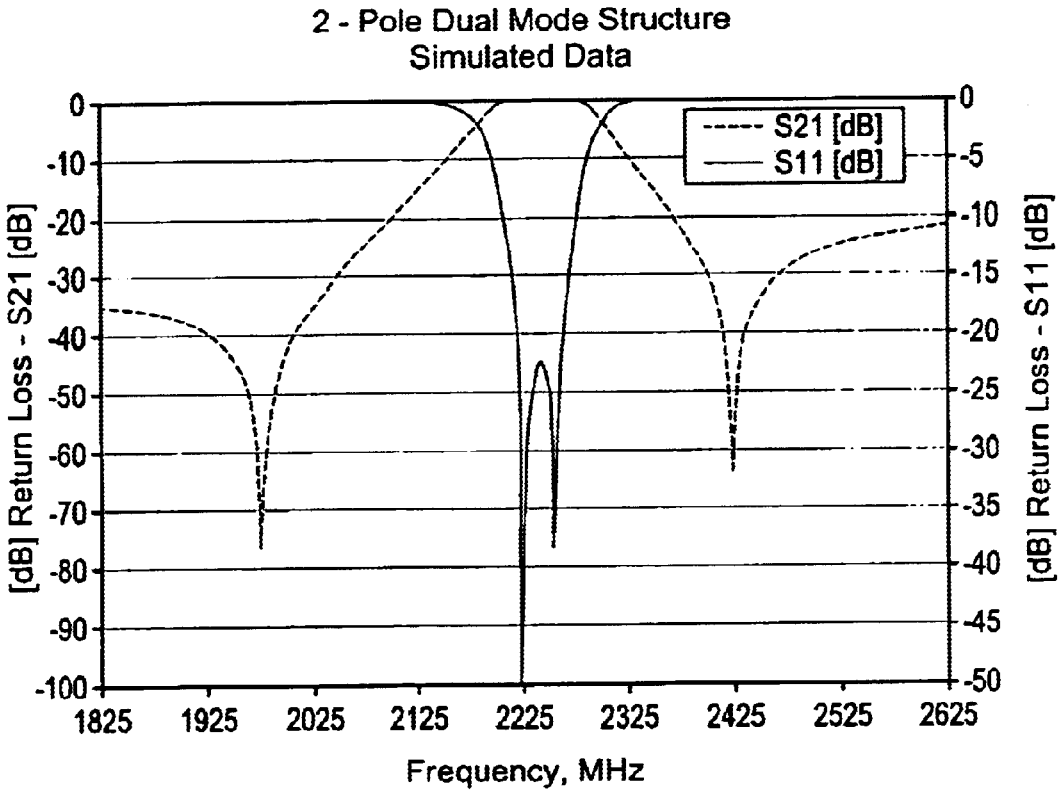
FIG. 23 illustrates the computed frequency response of the computer simulated filter structure of FIG. 21.

By way of non-limiting example, an actual embodiment of a two-pole dual-mode meandered filter structure was modeled in accordance with the meandered filter structure 200 illustrated in FIG. 20. This filter structure was composed of the same material and modeled in the same manner as the fabricated two-pole folded filter structure previously described, with the exception that the meandered filter structure was modeled with twenty-six de-embedded tap points (as illustrated in FIG. 22) to create the multi-port network. FIG. 23 shows the computed passband response of the modeled two-pole dual-mode meandered filter structure.

Figure 24:
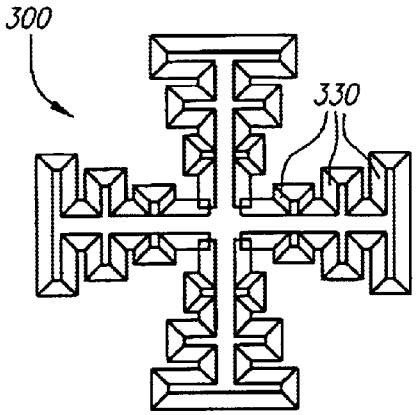
FIG. 24 illustrates another meandered ring resonator that can be used in the filter structure of FIG. 20, wherein shorter meanders are used.
Figure 25:
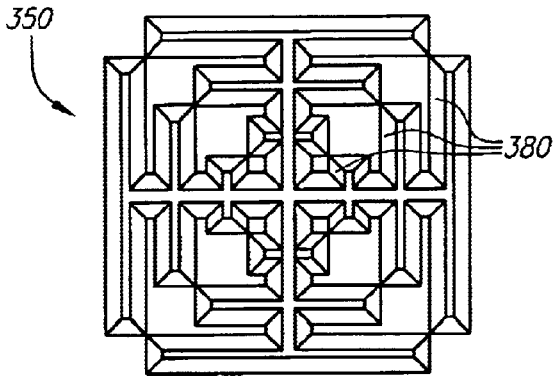
FIG. 25 illustrates another meandered ring resonator that can be used in the filter structure of FIG. 20, wherein longer meanders are used.
Figure 26:
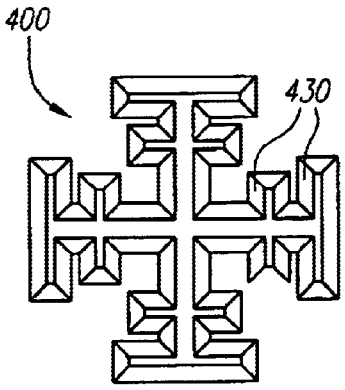
FIG. 26 illustrates another meandered ring resonator that can be used in the filter structure of FIG. 20, wherein each quadrangularly meandering configuration is formed with four meanders.
Figure 27:
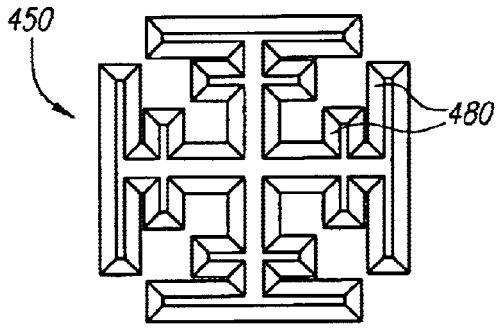
FIG. 27 illustrates another meandered ring resonator that can be used in the filter structure of FIG. 20, wherein each quadrangularly meandering configuration is formed with four longer meanders.

Other meandering configurations are contemplated. For example, FIG. 24 shows a two-pole dual-mode 300 that is similar to the previously described filter structure 200, with the exception that it comprises meanders 330, the lengths of which are shorter than the lengths of the meanders 220 of the meandered filter structure 200. In contrast, FIG. 25 shows a two-pole dual-mode filter structure 350 that is similar to the previously described filter structure 200, with the exception that it comprises meanders 380, the lengths of which are longer than the lengths of the meanders 220 of the meandered filter structure 200. FIGS. 26 and 27 respectively show two-pole dual-mode meandered filter structures 400/450 that are similar to the previously described filter structure 200, with the exception that they comprise four meanders 430/480 of differing-lengths, rather than six meanders in each quadrant.

Figure 28:
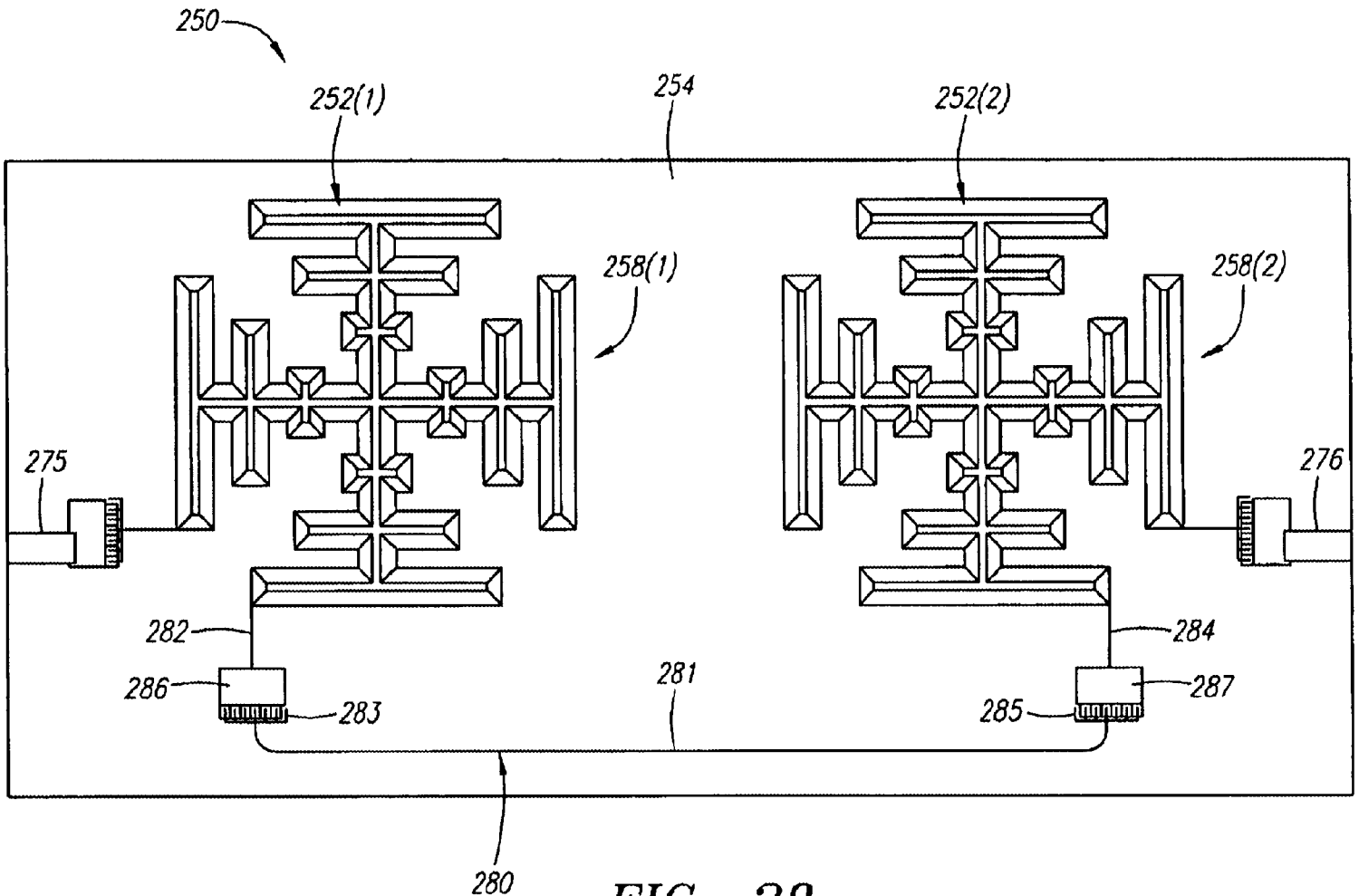
FIG. 28 illustrates a four-pole dual-mode meandered filter structure constructed in accordance with yet another preferred embodiment of the present inventions, wherein two meandered ring resonators similar to those used in the filter structure of FIG. 20 are used.

The dual-mode resonators of FIGS. 20 and 24–27 are building blocks that can be utilized to create more complex filters. Referring now to FIG. 28, a four-pole dual-mode meandered filter structure 250 constructed in accordance with another preferred embodiment of the present inventions will now be described. The meandered filter structure 250 generally comprises two meandered ring resonators 252(1) and 252(2) and a substrate 254, which has two regions 258(1) and 258(2) on which the two resonators 252 are respectively disposed. The composition and configuration of the resonators 252 and substrate 254 are identical to the previously discussed resonator 202 and substrate 204, and thus, will not be described in further detail. Although the resonators 252 use the meandering configuration 218 illustrated in FIG. 20 as shown, they can use other types of symmetrical configurations, such as the symmetrical configurations illustrated in FIGS. 24–27. Also, the resonators 252(1) and 252(2) can be disposed on two substrates similarly to that described with respect to FIG. 19.

Input and output couplings 275 and 276, which are similar to the previously described input and output couplings 175 and 176, are respectively coupled to the resonators 252(1) and 252(2). An interconnecting coupling 280 is coupled between the two resonators 252. The interconnecting coupling 280 includes interdigitated capacitors to more accurately represent ideal lumped element capacitor connections from the computer modeling. Specifically, the interconnecting coupling 280 comprises a common transmission line segment 281, a first transmission line segment 282 that is coupled to end of the common transmission line segment 281 via an interdigitated capacitor 283, and a second transmission line segment 284 that is coupled to the other end of the common transmission line segment 281 via another interdigitated capacitor 285. The high impedance transmission line segments 282 and 284 are directly connected to the resonators 152(1) and 152(2), thereby acting as points of contact. The interconnecting coupling 280 further comprises shunt capacitance structures 285 and 286 to provide additional shunt capacitance to the interconnecting coupling 280.

Figure 29:
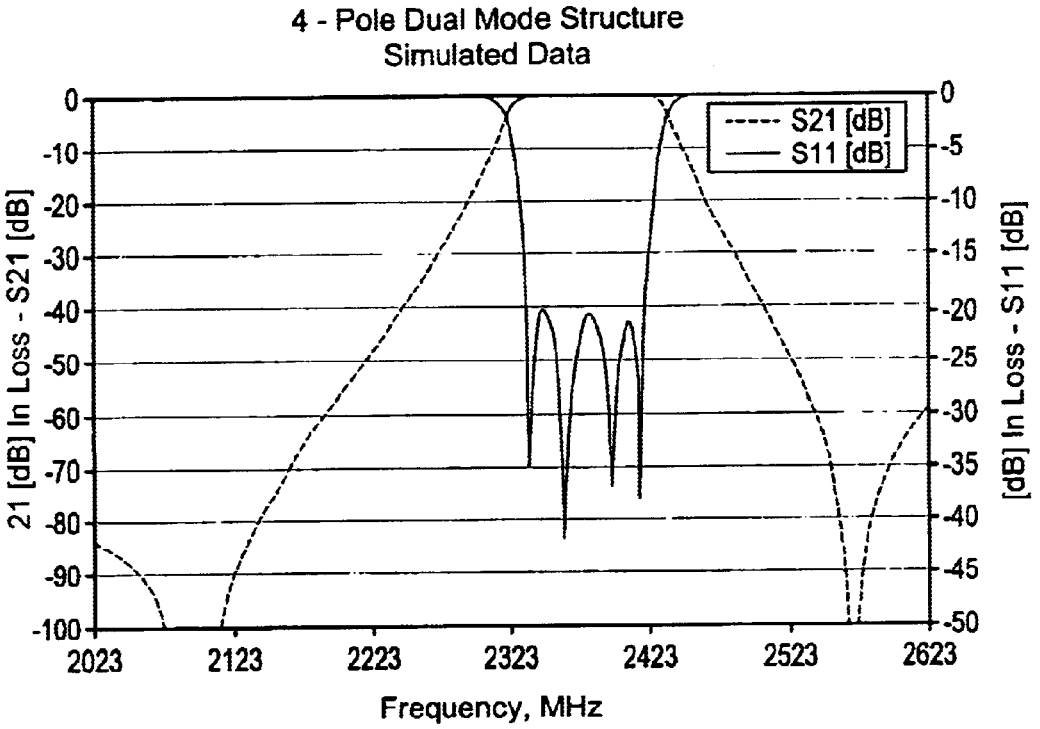
FIG. 29 illustrates the computed frequency responses of a computer simulated filter structure of FIG. 28.

By way of non-limiting example, an actual embodiment of a four-pole dual-mode meandered filter structure was modeled in accordance with the meandered filter structure 250 illustrated in FIG. 28. This filter structure was composed of the same material and modeled in the same manner as the fabricated two-pole meandered filter structure. FIG. 29 shows the simulated passband response of the modeled four-pole dual-mode meandered filter structure. As shown, the well-defined poles are, again, a result of the implementation of the interdigitated coupling technique and four-quadrant symmetry layout.

Although particular embodiments of the present inventions have been shown and described, it will be understood that it is not intended to limit the present inventions to the preferred embodiments,.and it will be obvious to those skilled in the art that various changes and modifications may be made without departing from the spirit and scope of the present inventions. Thus, the present inventions are intended to cover alternatives, modifications, and equivalents, which may be included within the spirit and scope of the present inventions as defined by the claims.

What is claimed is:

1. A dual-mode resonator, comprising:

a dielectric substrate having a region divided into four quadrants;

a ring resonator line forming quadrangularly symmetrical configurations within the four quadrants of the dielectric substrate; and input and output couplings coupled to the resonator line, wherein one or both of the input and output couplings comprises a transmission line directly connected to the resonator line and a capacitor coupled to the transmission line.

2. The resonator of claim 1, wherein both of the input output couplings comprises a transmission line directly connected to the resonator line and a capacitor coupled to the transmission line.

3. The resonator of claim 1, wherein the transmission line is a high impedance line.

4. The resonator of claim 1, wherein one or both of the input and output couplings further comprises another transmission line coupled to the capacitor.

5. The resonator of claim 4, wherein the transmission line is a high impedance line, and the other transmission line is a low impedance line.

6. The resonator of claim 1, wherein the capacitor comprises an interdigitated capacitor.

7. The resonator of claim 1, wherein the input and output couplings are coupled to the resonator line in a quadrangularly asymmetrical manner.

8. The resonator of claim 1, wherein the symmetrical configurations comprises meandered configurations.

9. The resonator of claim 1, wherein the resonator lines comprises folded segments that form the symmetrical configurations.

10. The resonator of claim 1, wherein the resonator line and dielectric structure form a planar structure.

11. The resonator of claim 1, wherein the resonator line and dielectric structure form a microstrip resonator.

12. The resonator of claim 1, wherein the resonator line is composed of High Temperature Superconductor material.

13. The resonator of claim 1, wherein the resonator line has a nominal linear length of one full wavelength at the resonant frequency.

14. The resonator of claim 1, further comprising input and output couplings coupled to the resonator line.

15. The resonator of claim 1, wherein the input and output couplings are coupled to the resonator line in a quadrangularly asymmetrical manner.

16. The resonator of claim 1, wherein one or both of the input and output couplings comprises a transmission line directly connected to the resonator line, and a capacitor coupled to the transmission line.

17. A dual-mode filter structure, comprising:

one or more dielectric substrates having a plurality of regions, each of which is divided into four quadrants;

a plurality of ring resonator lines respectively associated with the plurality of regions, each of the resonator lines forming quadrangularly symmetrical configurations within the four quadrants of the respective region;

an input coupling to a first one of said plurality of resonator lines; and an output coupling to a last one of said plurality of resonator lines;

wherein one or both of the input and output couplings comprises a transmission line directly connected to the respective resonator line and a capacitor coupled to the transmission line.

18. The filter structure of claim 17, wherein both of the input output couplings comprises a transmission line directly connected to the resonator line and a capacitor coupled to the transmission line.

19. The filter structure of claim 17, wherein the transmission line is a high impedance line.

20. The filter structure of claim 17, wherein one or both of the input and output couplings further comprises another transmission line coupled to the capacitor.

21. The filter structure of claim 17, wherein the transmission line is a high impedance line, and the other transmission line is a low impedance line.

22. The filter structure of claim 17, wherein the capacitor comprises an interdigitated capacitor.

23. The filter structure of claim 17, wherein the symmetrical configurations comprises meandered configurations.

24. The filter structure of claim 17, wherein the resonator lines comprises folded segments that form the symmetrical configurations.

25. The filter structure of claim 17, further comprising one or more couplings interconnecting the plurality of resonator lines.

26. The filter structure of claim 25, wherein each of the one or more couplings comprises first and second transmission line segments directly connected to the respective resonator lines, first and second capacitors respectively coupled to the first and second transmission lines, and a common coupling segment coupled between the first and second capacitors.

27. The filter structure of claim 26, wherein each of the first and second capacitors comprises an interdigital capacitor.

28. The filter structure of claim 17, wherein the plurality of resonator lines and one or more dielectric substrates form a planar structure.

29. The filter structure of claim 17, wherein the plurality of resonator lines and one or more dielectric substrates form a microstrip resonator.

30. The filter structure of claim 17, wherein each of the plurality of resonator lines is composed of High Temperature Superconductor material.

31. The filter structure of claim 17, wherein each of the plurality of resonator lines has a nominal linear length of one full wavelength at the resonant frequency.

32. The filter structure of claim 17, wherein the plurality of resonator lines comprises a pair of resonator lines.

33. The filter structure of claim 17, wherein the one or more substrates comprises a single substrate.

34. The filter structure of claim 17, wherein the one or more substrates comprises a plurality of substrates.

* * * * *